US008931196B1

(12) United States Patent
Larue

(10) Patent No.: US 8,931,196 B1
(45) Date of Patent: Jan. 13, 2015

(54) FIREARM HAVING CAPABILITY FOR FIELD ASSEMBLY AND DISASSEMBLY

(71) Applicant: Mark C. Larue, Leander, TX (US)

(72) Inventor: Mark C. Larue, Leander, TX (US)

( * ) Notice: Subject to any disclaimer, the term of this patent is extended or adjusted under 35 U.S.C. 154(b) by 0 days.

(21) Appl. No.: 14/083,235

(22) Filed: Nov. 18, 2013

(51) Int. Cl.
*F41C 23/16* (2006.01)
*F41A 11/04* (2006.01)

(52) U.S. Cl.
CPC ..... *F41A 11/04* (2013.01)
USPC ..... 42/71.01; 42/75.01

(58) Field of Classification Search
CPC ..... F41C 23/16; F41C 27/00; F41G 11/003; F41A 11/05
USPC ..... 42/71.01–73, 75.01–75.04, 90
See application file for complete search history.

(56) References Cited

U.S. PATENT DOCUMENTS 7,908,782 B1 * 3/2011 LaRue ..... 42/128
8,578,647 B2 * 11/2013 Storch et al. ..... 42/124
8,769,853 B1 * 7/2014 Larue ..... 42/71.01
2006/0123686 A1 * 6/2006 Larue ..... 42/127
2006/0191183 A1 * 8/2006 Griffin ..... 42/72
2006/0207156 A1 * 9/2006 Larue ..... 42/127
2007/0017139 A1 * 1/2007 Larue ..... 42/75.1
2011/0061284 A1 * 3/2011 Cabahug et al. ..... 42/73
2011/0119981 A1 * 5/2011 Larue ..... 42/71.01
2012/0049031 A1 * 3/2012 Larue ..... 248/316.1
2012/0167442 A1 * 7/2012 Larue ..... 42/130
2013/0036650 A1 * 2/2013 Larue ..... 42/148
2013/0333263 A1 * 12/2013 Hovey ..... 42/72
2014/0076147 A1 * 3/2014 Larue ..... 89/191.01
2014/0076148 A1 * 3/2014 Larue ..... 89/191.01
2014/0082985 A1 * 3/2014 Larue ..... 42/90

* cited by examiner

*Primary Examiner* — Michael David
(74) *Attorney, Agent, or Firm* — James L. Jackson

(57) ABSTRACT

A firearm having modular components that can be assembled under field conditions, by using simple tools. Upper and lower receivers are assembled by pins and a barrel and gas tube are secured to the upper receiver by a barrel nut. Mounting flanges of the upper receiver and a handguard are secured in reliable assembly by a manually actuated clamp mechanism having a clamping condition releasably securing the handguard to the upper receiver and having a releasing condition permitting separation of the handguard from the upper receiver. A pocketed soft protective container receives and protects the modular firearm components until firearm assembly takes place.

18 Claims, 9 Drawing Sheets

FIREARM HAVING CAPABILITY FOR FIELD ASSEMBLY AND DISASSEMBLY

RELATED PROVISIONAL APPLICATION

Applicant hereby claims the benefit of U.S. Provisional Patent Application No. 61/796,766, filed on 19 Nov. 2012 by Mark C. LaRue and entitled "Firearm Having Capability For Field Assembly and Disassembly", which provisional application is incorporated herein by reference for all purposes.

BACKGROUND OF THE INVENTION

Field of the Invention

The present invention relates generally to firearms, particularly shoulder fired firearms, such as rifles and more particularly concerns firearms that are designed and constructed for quick and simple assembly and disassembly, even in field conditions, through the use of simple tools. Even more specifically, the present invention concerns a firearm having several sub-assemblies that can be stored and transported in a compartmented bag or other container to facilitate ease of transportation and use.

SUMMARY OF THE INVENTION

It is a principal feature of the present invention to provide a novel firearm that comprises a plurality of sub-assemblies that can be easily and efficiently assembled in a few minutes time with only a few simple tools and yet has extreme accuracy when used.

It is another feature of the present invention to provide a novel shoulder fired firearm, such as a tactical rifle, having a number of sub-assemblies that can be stored in a compartmented bag, a conventional carrier bag or any other suitable container and can be assembled and disassembled in field conditions, even during conditions of poor light, without risk of losing any of the components of the firearm.

It is also a feature of the present invention to provide a novel bag or container that is internally compartmented to permit the individual sub-assemblies of the firearm to be stored and transported within individual compartment for protection and are organize to promote sequential assembly of the firearm sub-assemblies, even during conditions of poor light and during field conditions, without risk of losing any of the sub-assemblies or firearm components.

Briefly, the various objects and features of the present invention are realized through the provision of a firearm, particularly in the form of a rifle, typically a tactical rifle which has extreme accuracy, in that it will consistently achieve accuracy from ½ to one minute of angle (MOA) or better. The firearm is designed with its components arranged in a plurality of sub-assemblies that can be assembled with screws, particularly screws that are maintained as "in-place" components of the sub-assemblies or by means of clamps, nuts or other connecting devices that are also maintained in place to prevent loss thereof when assembly and disassembly is being accomplished during field conditions and during conditions of poor light.

An important aspect of the present invention is the provision of an external manually operable latch mechanism for releasably securing a handguard module to an upper receiver module. After a barrel module or section having a gas block and gas tube has been assembled to a threaded barrel mount of an upper receiver section, by threading and tightening a barrel retainer nut onto the barrel mount, a handguard section is positioned about the barrel section and brought into engagement with a handguard mount of the upper receiver section. Externally projecting mount flanges of the upper receiver section and the handguard section are positioned with planar surfaces thereof in engagement and alignment. A manually operated latch mechanism or mechanisms having a pair of pivotally mounted latch operating levers is moveable to a latching position, applying traction force to a pair of clamp retainer members that are drawn into secure retaining engagement with the mount flange of the upper receiver section.

For transportation in disassembled condition, the various sub-assemblies of the firearm are transported in a bag or container of any suitable character, such as a compartmented low-profile storage bag that can be transported by the user of the firearm or can be stored in a transportation container of any suitable character. During field conditions, the low profile storage and transportation bag can be fitted with a sling so that the firearm can be carried in hands-free manner and can be assembled and used as suits the needs of the user.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevation view showing an assembled firearm incorporating the principles of the present invention;

FIG. 2 is a side elevation view showing an upper receiver of the firearm of FIG. 1;

FIG. 3 is a side elevation view showing a handguard of the firearm of FIG. 1, being positioned in registry with the upper receiver of FIG. 2 for connection therewith by means of screws, clamps or other connection or fastener systems;

FIG. 4 is a side elevation view showing a lower receiver of the firearm of FIG. 1, the lower receiver being mounted to the upper receiver of FIG. 2 by means of a pivot pin;

FIG. 5 is a side elevation view showing a barrel, gas block and gas tube sub-assembly of the firearm of FIG. 1 which carries a barrel nut for assembly thereof to a circular threaded projection of the upper receiver of FIG. 2;

FIG. 6 is a side elevation view showing the tools, such as a wrench and screwdriver, that are needed for assembly and disassembly of the firearm and a buffer and return spring assembly for controlling the bolt carrier and bolt mechanism of the firearm;

FIG. 7 is a side elevation view showing the butt-stock mechanism of the firearm, which is mounted to the lower receiver mechanism of FIG. 4;

FIG. 8 is an isometric illustration showing an embodiment of the firearm of the present invention in assembled condition and incorporating a quick-disconnect latch mechanism for releasably securing the handguard to the upper receiver;

FIG. 9 is a top view of the firearm of FIG. 8;

FIG. 10 is a side elevation view of the firearm of FIG. 8;

FIG. 11 is a front view of the firearm of FIG. 8:

Figure 12:
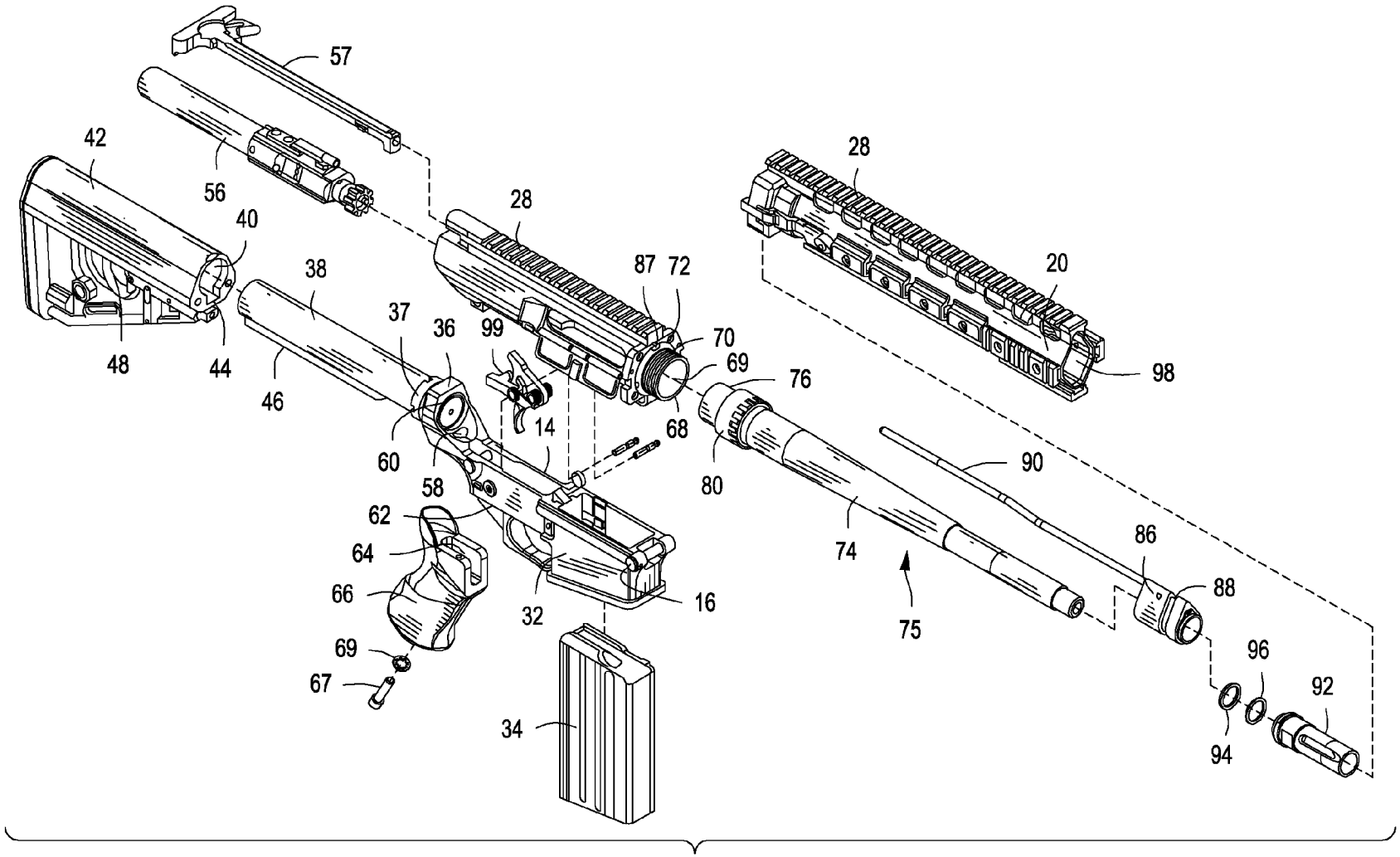

FIG. 12 is an exploded isometric illustration showing the components of the firearm of FIGS. 1 and 8-11

Figure 13:
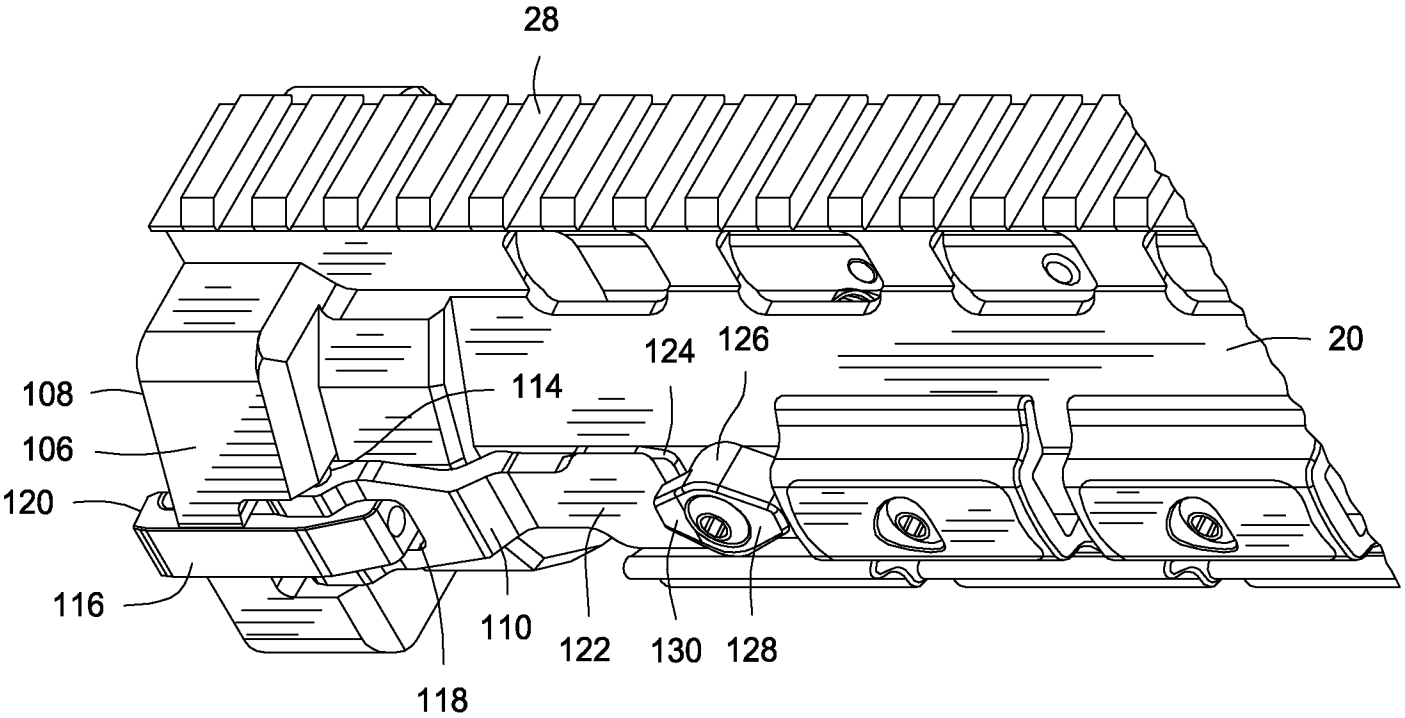
Figure 14:
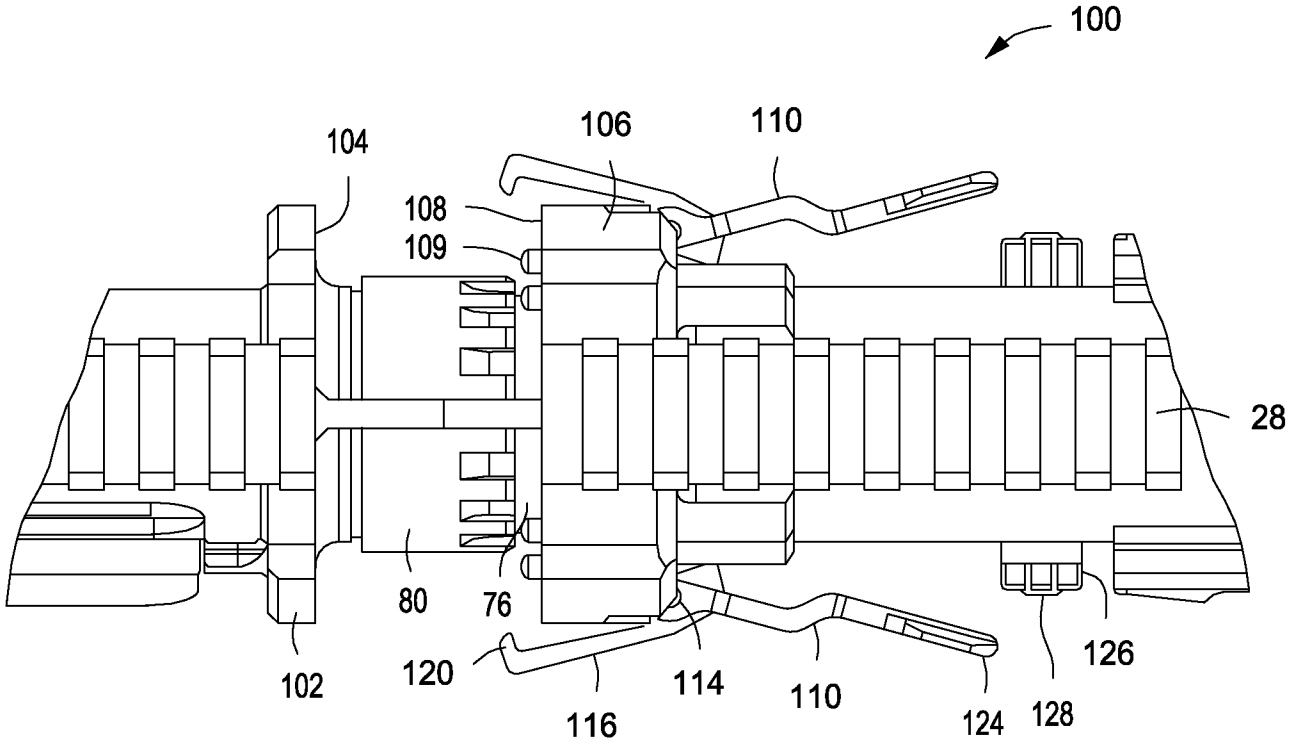
Figure 15:
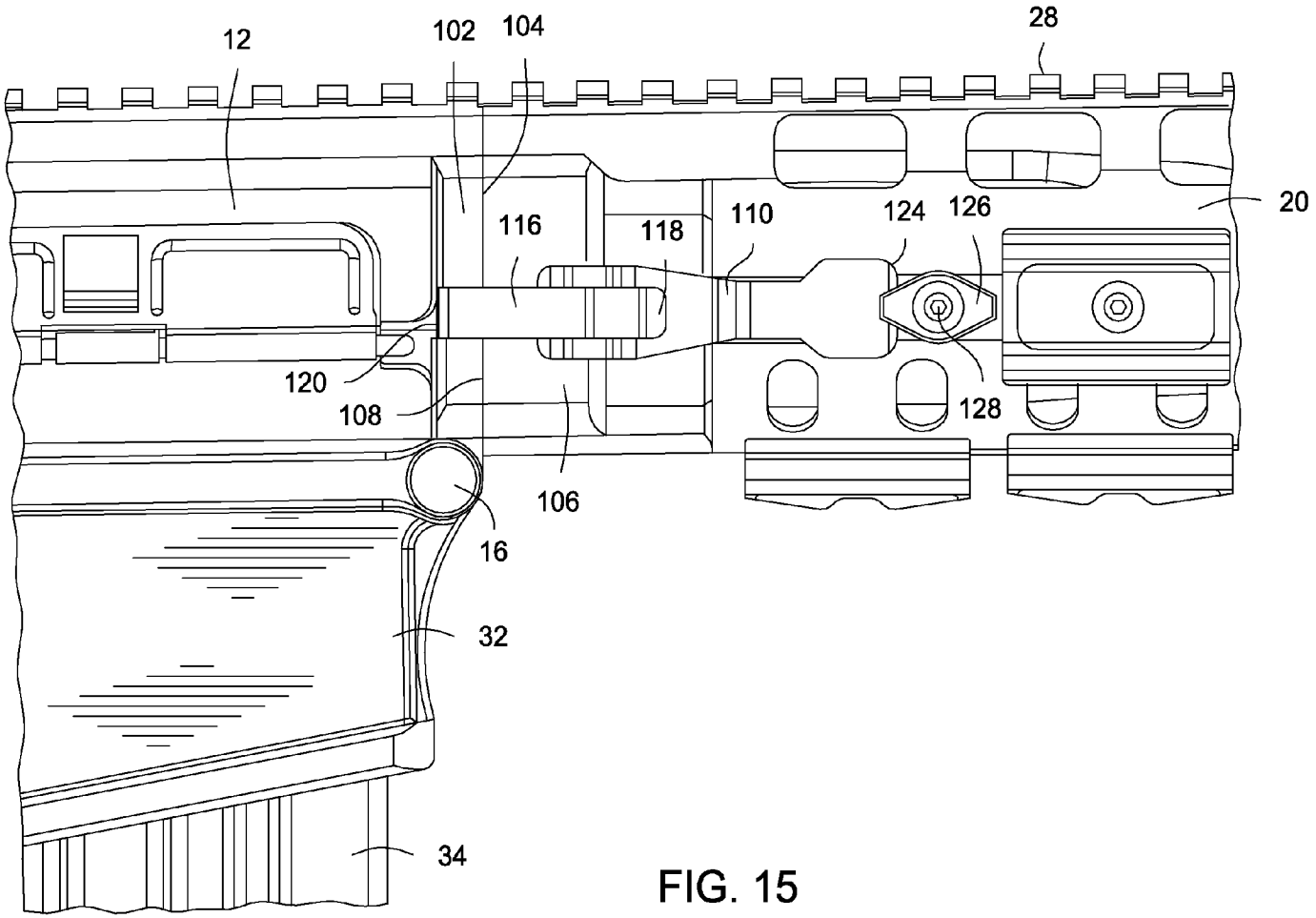

FIG. 13 is a fragmentary isometric illustration showing a draw latch type clamp mechanism for releasably securing the handguard to the upper receiver;

FIG. 14 is a fragmentary top view showing the handguard being separated from the upper receiver, showing the barrel nut being threaded to the upper receiver and showing the draw-latch clamps of the handguard at the open positions thereof in readiness for drawing the mounting flanges of the upper receiver and handguard into precision fitting relation and clamping the handguard to the upper receiver:

FIG. 15 is a fragmentary elevation view showing the closed and latched condition of the draw latch mechanism, securing the handguard in releasable assembly with the upper receiver.

Figure 17:
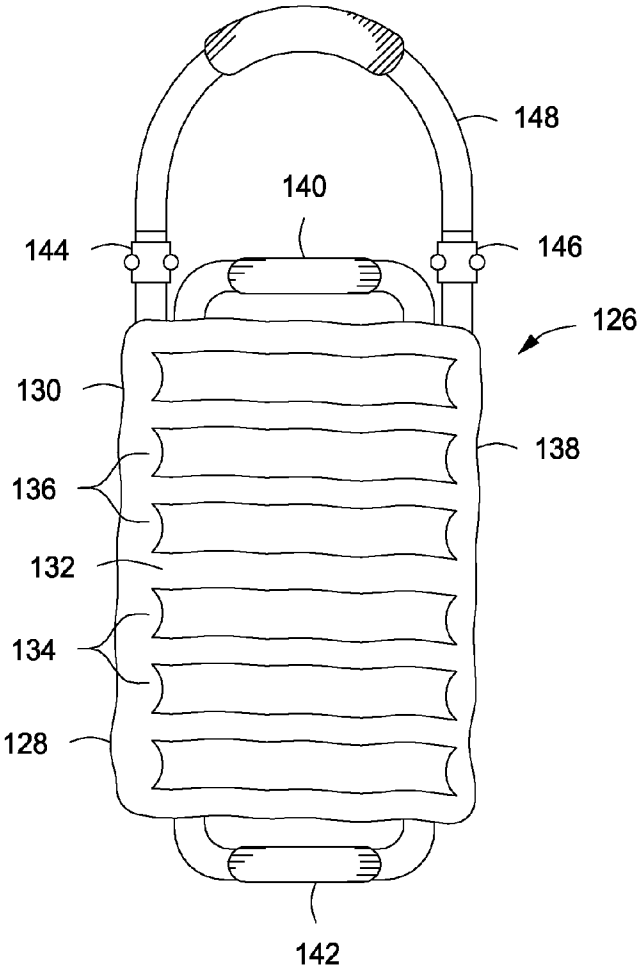
Figure 16:
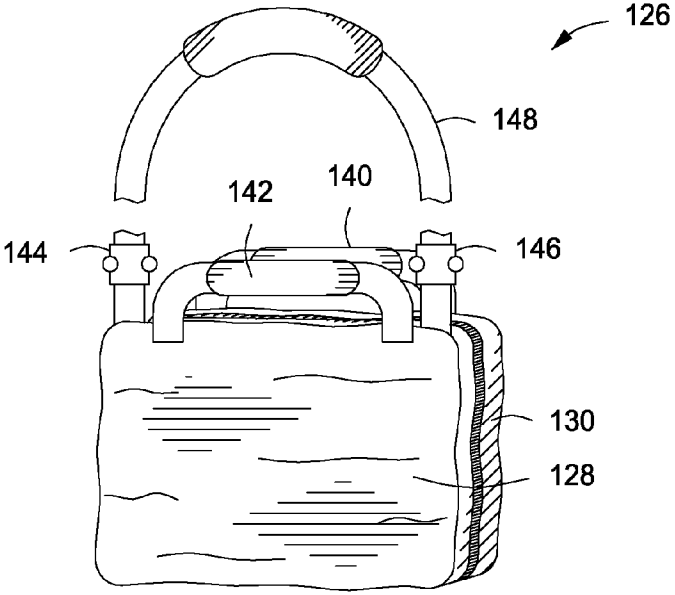

FIG. 16 is an isometric illustration, showing the closed view of a durable, padded storage and transportation bag for containing and protecting the sub-assembly components of the firearm of the present invention and having both carry straps with padded handles and a detachable shoulder strap that can also serve as a sling for the firearm; and FIG. 17 is an elevation view showing the open condition of the durable, padded storage and transportation bag of FIG. 16, with a plurality of lateral compartments being shown for protected storage and transportation of the sub-assemblies of the firearm.

DETAILED DESCRIPTION OF PREFERRED EMBODIMENT

Figure 1:
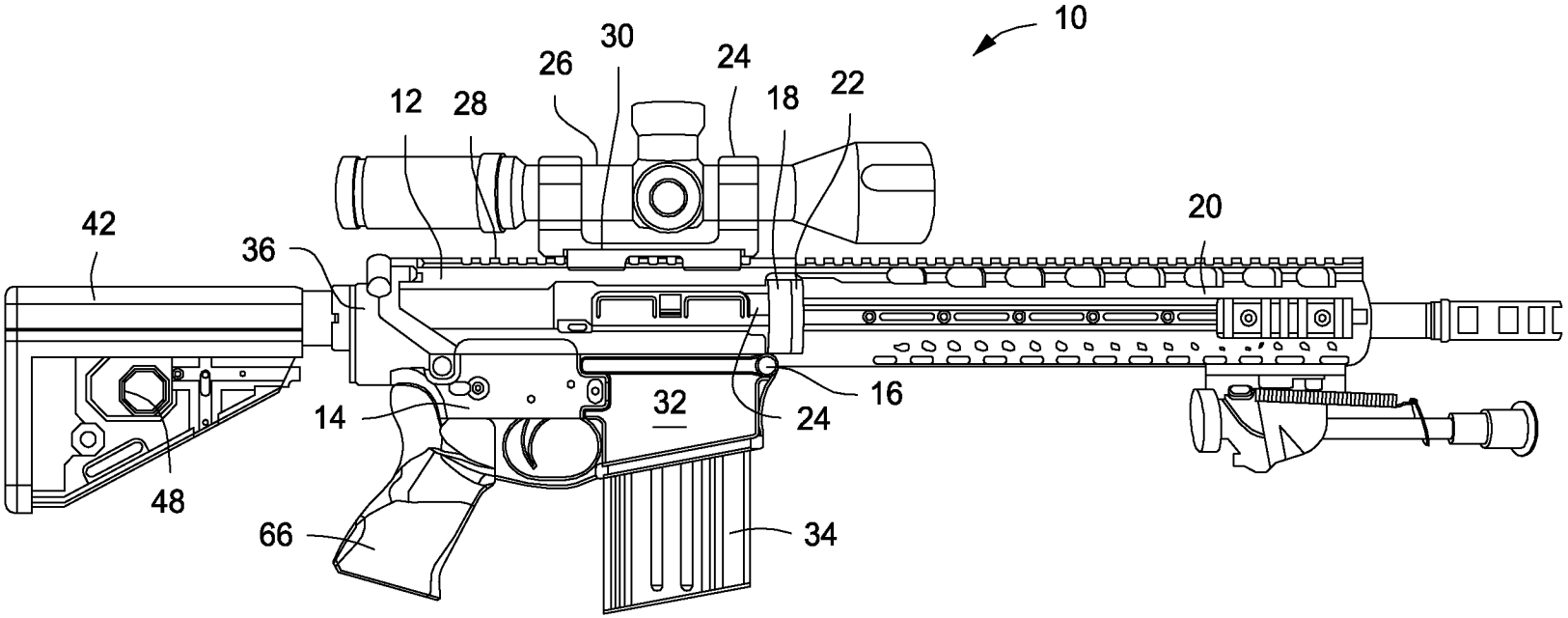
Figure 3:
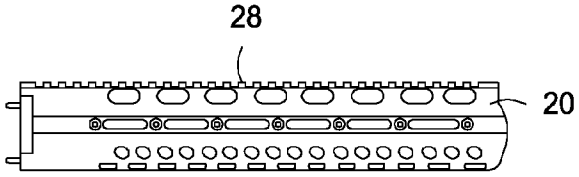
Figure 2:
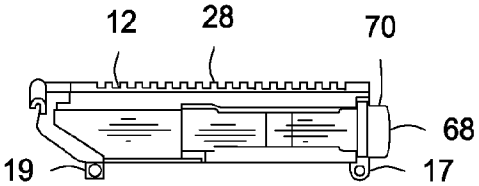

Referring now to the drawings and first to FIG. 1, a shoulder fired firearm, such as a tactical rifle is shown generally at 10 and is comprised of a plurality of sub-assemblies, with each of the sub-assemblies incorporating the necessary components of the firearm. One of the sub-assemblies of the firearm is an upper receiver assembly 12, which is pivotally mounted to a lower receiver assembly 14 by means of a pivot pin 16. The pivot pin 16 is received by a pivot projection 17 which defines a pivot hole within which the pivot pin is engaged. A latch projection 19 is defined by the upper receiver 12 and is provided with a locking hole within which is received a locking pin 21 that is extended through locking holes of the lower receiver member to secure the upper and lower receivers at the closed positions thereof. Relative pivoting of the upper and lower receivers about the pivot pin 16 can only be accomplished by first removing the locking pin 21 from the locking holes.

Figure 6:
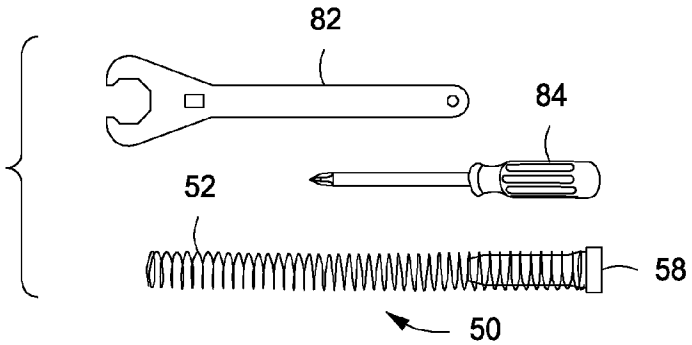
Figure 8:
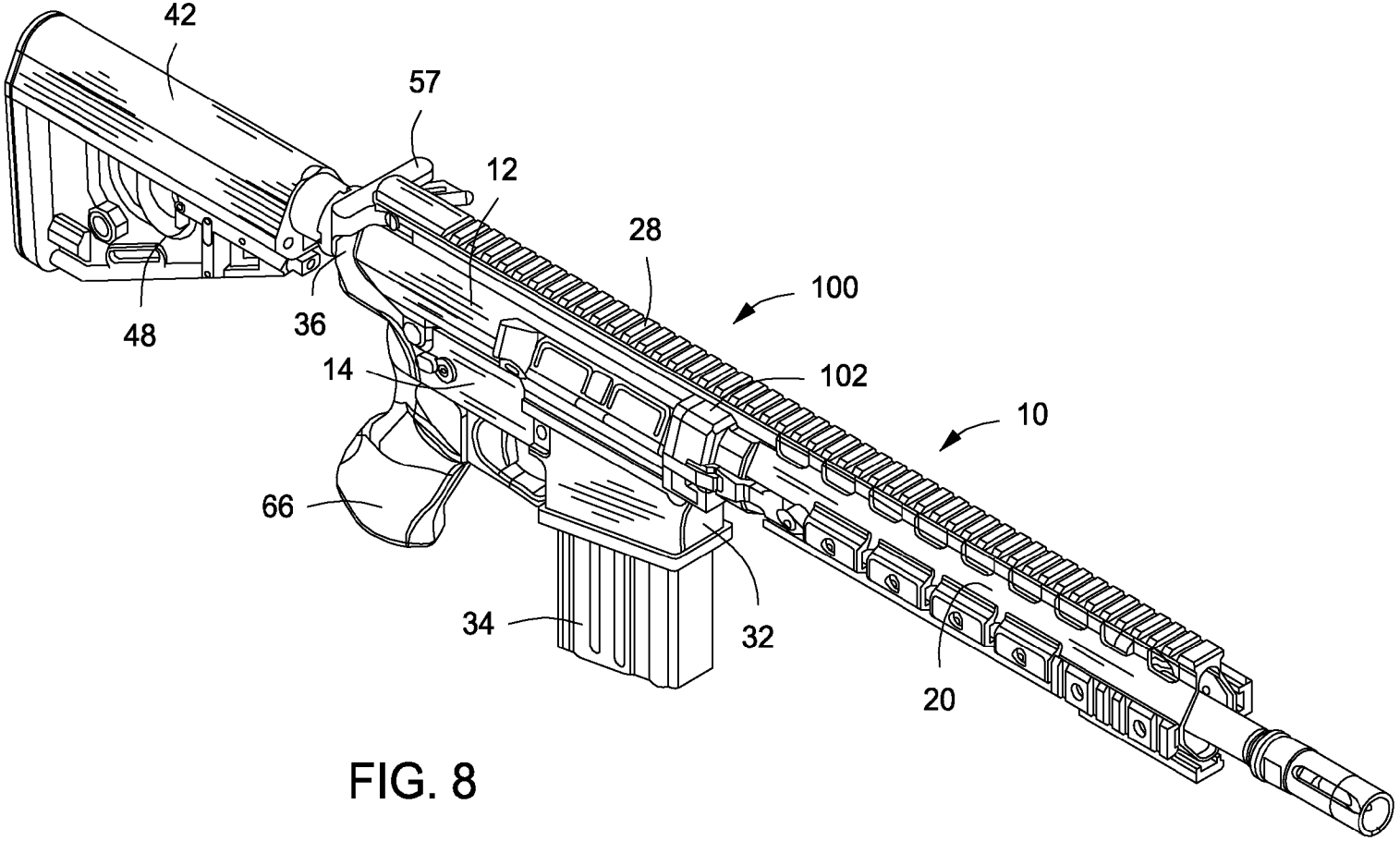

The upper receiver assembly defines a handguard mounting flange 18. A handguard 20 is provided with a second handguard mounting flange 22 which is positioned in registering engagement with the handguard mounting flange 18. The handguard mounting flanges 18 and 22 are secured in assembly by means of mounting screws 24 or by means of quick release clamp members as discussed in detail below. The mounting screws 24 are arranged so that they are retained in assembly with screw holes in the mounting flange 18 and are thus not susceptible of becoming lost when the handguard and upper receiver are separated. To mount the handguard 20 to the upper receiver 12, the user only needs to place the handguard so that the mounting flanges 18 and 22 are in assembly and tighten the mounting screws with a screwdriver, such as shown in FIG. 6. If the handguard is provided with a latch or clamp mechanism, as shown in FIGS. 9-15, the user, after positioning the handguard so that the mounting flanges are in assembly, will need only to actuate the latch or clamp mechanisms to secure the mounting flanges in releasable assembly.

A sighting device, such as an optical sight 26, shown in FIG. 1, mechanical front and rear sights, a laser sighting device, etc., may be mounted to an accessory mounting rail 28 by means of any suitable sight mount device. As shown in FIG. 1 the sight mount device 30 is preferably a lever actuating clamping sight mount that embodies the principles set forth in U.S. Pat. No. 7,272,904 of Mark C. LaRue. The LaRue patent incorporates features that permit the mount to be disassembled from the accessory mounting rail 28 by actuating locking levers to their release or unlocking positions and simply removing the sight mount and the sighting device from the accessory mounting rail. It should be noted that the accessory mounting rail 28 extends along the combined length of the upper receiver and the handguard as is evident from FIG. 12. The sight mount device 30 may then be re-assembled to the accessory mounting rail and secured to the rail by actuation of the locking levers to their locking positions. When so positioned and locked, the sighting device 26 will be precisely located at its pre-adjusted zero, so that the firearm may be immediately used for precision shooting, without necessitating test firing and further zero adjustment.

The lower receiver 14 is provided with a magazine receptacle 32 that is adapted to receive a magazine 34 containing a number of cartridges that are fed into the firing chamber of the firearm barrel by cycling activity of the bolt carrier and bolt mechanism that are located within the upper receiver.

The lower receiver 14 of the firearm 10 defines an upwardly projecting buttstock mount 36 to which a buffer tube 38 is threadedly mounted as is more clearly evident from the exploded view of FIG. 12. A lock nut 37 is employed to secure the buffer tube against rotation from its secured position. The buffer tube 38 also serves as a supporting structure that is received within a buffer tube receptacle 40 of a butt-stock mechanism 42. The buffer tube receptacle is defined in part by an elongate slot 44 of generally rectangular cross-section within which an elongate downwardly facing rib 46 of the buffer tube is received. The downward facing rib 46 is provided with adjustment holes or other adjustment structures along its length so that an adjustment pin carried by the butt-stock mechanism can enter selected ones of the adjustment holes as desired. The butt-stock mechanism is linearly moveable with respect to the buffer tube 38, thus permitting the position of the butt-stock to be adjusted according to the needs of the user of the firearm. A trigger-like mechanism 48 is manually manipulated by the user to select the position of the butt-stock along the length of the buffer tube as suits the needs of the user.

A buffer and return spring assembly shown generally at 50 in FIG. 6, has a buffer spring member 52 that is received within a buffer chamber that is defined within the buffer tube 38. The buffer and return spring assembly 50 has a spring guide member 54 that prevents the spring 52 from becoming kinked or misaligned as it is compressed by cartridge gas pressure induced rearward movement of the bolt carrier and bolt assembly 56 within the buffer tube 38. The spring guide member includes a head portion 58 that is positioned within the internal chamber of the buffer tube 38 and is secured against movement out of the internal buffer tube chamber by means of a retainer clip 60. Thus, unlike conventional AR 15 type tactical rifles, separation of the butt-stock from the upper receiver will not cause the spring and spring guide member to be ejected from the buffer tube and possibly becoming lost. The bolt carrier and bolt assembly 56 is also rearwardly moveable by manual application of a pulling force on a charging handle 57 that is sufficient to overcome the force of the buffer and return spring 52.

The lower rear portion of the lower receiver member 14 is provided with a handle or hand grip mount 62, which is received within a hand grip mount receptacle 64 of a replaceable handle 66. A hand grip mounting screw 67 and a washer 69 are employed to secure the hand grip to the lower receiver structure. The handle 66 may be composed of a metal material if desired; however, it is preferably composed of a lightweight durable material such as rubber or any of a number of suitable polymer materials. The handle structure preferably has an external geometry and surface that is easy and efficient to grip. This feature enables a user of the firearm to support the firearm simply by gripping the handle, if desired.

The upper receiver 12 also defines a circular barrel mount projection 68 that defines an external threaded section 70. The circular barrel mount projection 68 also defines a barrel location slot 72 that is engaged by a barrel alignment member to ensure proper alignment of a barrel member 74 with respect to the upper receiver member. The barrel member 74 is the principal component of a barrel sub-assembly shown generally at 75. A rear end portion 76 of the barrel member 74 is received within a barrel attachment receptacle 78 of the circular barrel mount projection 68 with the barrel alignment member of the barrel engaged within the barrel location slot 72. A barrel retainer nut member 80 is rotated manually to thread the barrel nut onto the threaded section 70 of the circular barrel mount projection 68. The barrel retainer nut is then tightened to the desired range of torque by using a simple barrel nut wrench 82 that is shown in FIG. 6. The barrel nut wrench 82 is supplied along with a screwdriver 84 in a kit that includes the sub-assemblies of the firearm as described in greater detail below. Since Torx screws are widely used in firearm assemblies, the screwdriver may be specifically adapted to drive a preferred size of Torx screws, such as "T-15", for example. However, it is intended to be clear that any desired size and character of retainer screws may be used. To minimize the number of tools that are required for assembly and disassembly of firearms from sub-assemblies, it is desired that all of the retainer screws be of the same character and size so that a single screwdriver will suffice.

As mentioned above, it is intended that the firearm of the present invention incorporate a number of sub-assemblies that are each manufactured and arranged to be self-contained, so that no sub-assembly can lose any of its parts when the subassembly is stored and handled. As also mentioned above, a low-profile firearm component bag is intended to contain and protect the individual sub-assemblies until such time as the sub-assemblies are assembled for firearm use. The low-profile firearm component bag is preferably compartmented, as shown in FIGS. 16 and 17, so that the sub-assemblies are received within individual compartments and are protected from damage even when the component bag is roughly handled. Though a storage and transportation bag is preferred, because it can be padded for protection of the sub-assemblies, it is also possible to use a case device, perhaps with interior padding or cushioning material, to store the disassembled sub-assemblies and to provide for safe and efficient transportation.

Figure 5:
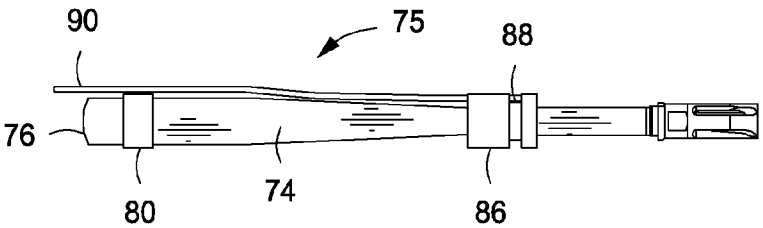
Figure 4:
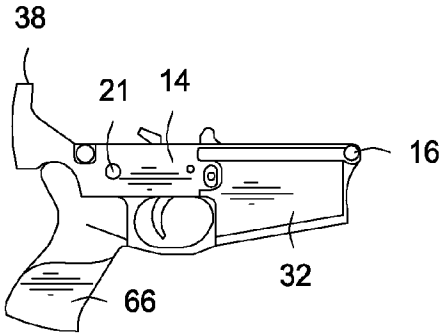
Figure 7:
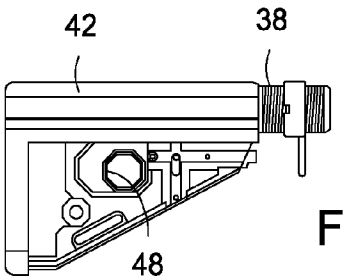

The collection of firearm sub-assemblies includes a barrel sub-assembly, shown generally at 75, which is shown in its sub-assembly form in FIG. 5 and is shown in its disassembled form in FIG. 12. The barrel sub-assembly 75 incorporates a barrel 74, which is provided with a mounting end 76 that is of a cylindrical external dimension that is closely but easily received within the barrel mounting chamber 69 of the circular barrel mount projection 68. The barrel 74 also includes an external circular mounting flange 78 that is spaced from the rear end of the barrel and, when the barrel is properly seated, is disposed in positioning engagement with the circular barrel mount projection 68. A barrel retainer nut 80, which is maintained in assembly with the barrel member 74, and thus cannot become separated and lost, is threaded onto the externally threaded section 70 of the circular barrel mount projection 68 and is intended to be tightened to a desired torque. The wrench 82 shown in FIG. 6 will provide the user of the firearm with the capability for tightening or loosening the barrel nut as needed.

The barrel assembly 75, as shown in FIGS. 5 and 12 also includes a gas block 86 which is mounted about the barrel 74 in position to receive cartridge gas from ports that are formed in the barrel. A port selector 88 is provided adjacent the gas block and can be manipulated to open or close one of the gas ports of the barrel. This feature permits gas volume and pressure changes that adapt the firearm for selective use of compensator devices and other cartridge gas energized firearm components as well. A gas tube 90 is secured in communication with an internal gas supply passage of the gas block. The rear end portion of the gas tube 86 is received within a gas transfer opening 87 of the upper receiver 14 when the rear portion of the barrel 74 is secured to the external threaded section 70 of the upper receiver, as described above. Cartridge gas pressure flows from the gas block through the gas tube and into internal gas passages of the upper receiver and acts upon the exposed surface area of the bolt and bolt carrier. The gas pressure provides a rearwardly acting gas induced force that drives the bolt and bolt carrier assembly rearward, thus moving the spring guide member 58 rearwardly and further compressing the buffer spring 82. The barrel 74 preferably includes a flash hider member 92 that is threaded and locked or pinned to the forward end portion of the barrel and is sealed to the barrel by means of annular seal members 94 and 96.

Another sub-assembly of the firearm assembly 10 is the handguard member 20. The handguard defines an internal chamber 98 within its length that is of sufficient dimension to receive the barrel assembly therein. For this type of firearm, the barrel assembly 75, which is the longest sub-assembly of the firearm, is of minimal length. For example, the barrel assembly of a particular 7.62 mm firearm is only 16.75 inches in length and thus can be stored in a very small space within a storage and handling bag or other type of storage and transportation container.

The upper receiver 14 and its internal components make up another of the sub-assemblies of the firearm 10. For example, as shown in FIG. 12, the upper receiver assembly includes the bolt and bolt carrier assembly 56 and also includes the charging handle 57.

Another sub-assembly of the firearm 10 is the lower receiver assembly 14, which includes the handgrip 66 and a trigger group 99 that is secured within the lower receiver. The lower receiver assembly may also include the buffer tube 38 if desired. However, to minimize the length of the lower receiver assembly, the buffer tube 38 may be caused to remain within the internal compartment 40 of the butt-stock mechanism. During assembly, the buffer tube is simply threaded into the upwardly projecting butt-stock mount 36 and secured in position by means of a lock nut 37.

The butt-stock mechanism 42 and its buffer tube 38 constitute another of the sub-assemblies of the firearm mechanism, which may include the buffer tube and its buffer spring and spring guide members.

FIGS. 9-15 disclose a firearm embodiment, being the preferred embodiment and best mode of the invention, wherein the handguard member is releasably secured to the upper receiver member by means of a clamp or latch mechanism, to ensure the capability for assembly and disassembly of the handguard and the upper receiver, without any need for tools of any sort. Otherwise, the firearm assembly is essentially the same as discussed in detail above and as indicated by like reference numerals.

Figure 9:
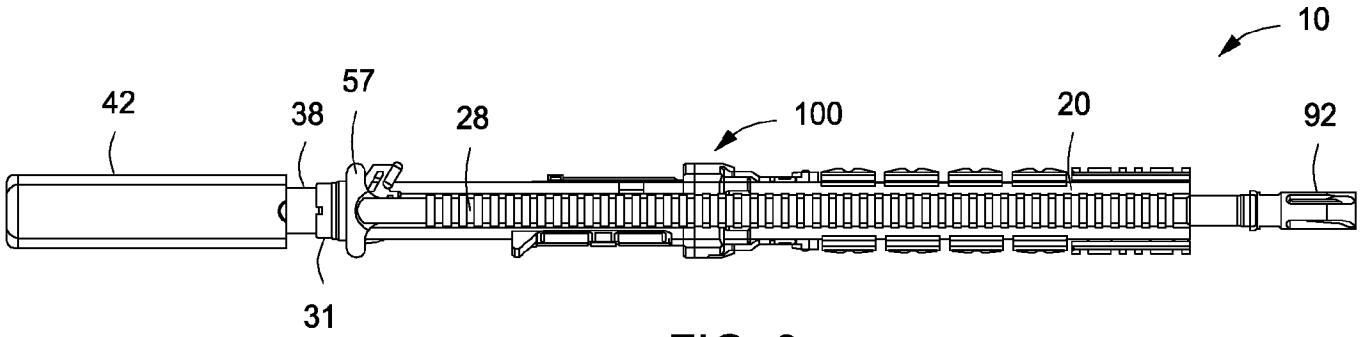
Figure 10:
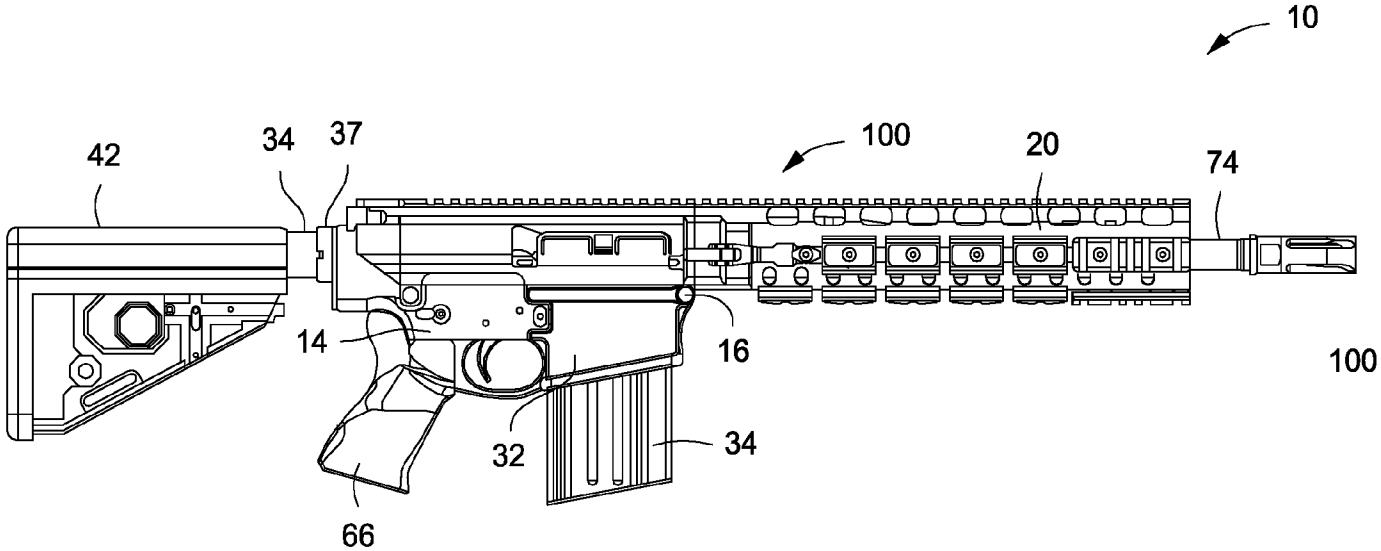
Figure 11:
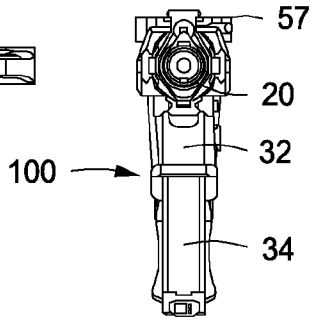

FIG. 9 is a top view of the firearm assembly, showing the handguard being secured to the upper receiver by means of a clamp or latch assembly, shown generally at 100. The upper receiver member 12 is provided with a first handguard mounting flange member 102, which is preferably integral with the upper receiver member, but which may be secured to the upper receiver member by welding or by any other suitable means. The first handguard mounting flange member 102 defines a substantially planar handguard mounting face 104 that is oriented substantially perpendicular to the axis of the bore of the barrel member 74. The handguard member 20 defines a second handguard mounting flange member 106 that defines a second substantially planar handguard mounting face 108 that is intended to be positioned in face-to-face relation with the substantially planar handguard mounting surface 104 as shown in the enlarged view of FIG. 15. Handguard locator pins 109 project from the second mounting flange member 106 and upon assembly of the handguard to the upper receiver, engage within corresponding handguard locator holes of the upper receiver to ensure precision positioning of the handguard with respect to the upper receiver. Preferably, the handguard locator holes are provided in the mounting flange 102 and intersect the planar surface 104. It should be noted that the first mounting flange member 102 is of relatively thin construction and the second mounting flange member 106 is of fairly thick construction. This arrangement permits draw latch type clamp mechanisms to be mounted to the second mounting flange member 106 and to provide for clamping of the first mounting flange in tight engagement with the second mounting flange 106, so that the planar handguard orienting surfaces will be maintained in tight, substantially immoveable engagement and the handguard member will be secured in releasable but positively secure relation with the upper receiver.

The clamp or latch assembly 100 includes at least one and preferably two or more clamp assemblies, each having a clamp actuator lever 110 that is mounted to the second mounting flange 106 by means of a pivot member 112. A clamp member 116 is connected with the clamp actuator lever 110 at a point 118 that is remote from the pivot member 112 so that movement of the clamp actuator lever 110 from its open or release position, shown in FIG. 14 to its closed and latched position, shown in FIGS. 13 and 15 causes an over-center actuation that applies a pulling force to the clamp member 116, essentially pulling or drawing the clamp member forwardly. The clamp member 116 defines a hook-like rear end portion 120 that is designed for clamping engagement with the first mounting flange member 102 of the upper receiver 12 and for urging the first mounting flange member 102 into tight engagement with the second mounting flange member 196 and causes tight surface-to-surface engagement of the planar surfaces 104 and 108.

The forward end portions 122 of each of the clamp actuator levers 110 define relatively thin and flexible outturned lever ends 124 that, in the closed or. A lever keeper 126 is rotatably mounted to the handguard 20 by means of a fastener member 128, such as a retainer screw. With the clamp actuator levers 110 at the closed positions thereof as shown in FIG. 13 the keeper members 126 are rotated to position a retaining portion 130 thereof in force transmitting engagement with the thin and flexible outturned lever ends 124. The fastener member 128 will be sufficiently tightened that the keeper member can be forcibly rotated manually, so that it will not inadvertently rotate from its locking position as shown in FIG. 13. At the position shown in FIG. 13, the keeper member will apply sufficient force to the flexible outturned lever ends 124 of the clamp actuator levers to cause slight flexing of the outturned lever ends. This feature will develop sufficient frictional resistance to ensure that the keeper members will be maintained at the latched or locked positions thereof, thus preventing release of the clamp actuator levers for opening movement. Of course, when opening or unlatching movement of the clamp actuator levers is desired, the keeper members will be manually rotated to their release positions, thus permitting the clamp actuating levers to be pivotally moved to the open positions thereof, as shown in FIG. 14, thus moving the clamp members 116 to their release positions to allow separation of the handguard from the upper receiver during disassembly of the firearm.

With regard to FIGS. 16 and 17, and as mentioned above, it is desirable to provide an efficient means for storage and transportation of the disassembled sub-assemblies or modules of the firearm of the present invention and to ensure protection of the sub-assemblies from damage or excessive wear during transportation and handling. As shown in FIGS. 16 and 17 a padded storage and transportation bag or container is shown generally at 126 and comprises front and rear bag sections 128 and 130 that are connected by a center-fold 132. The interior portions of each of the front and rear bag sections define a plurality of pockets 134, each having an opening 136 through which a sub-assembly of the firearm can be inserted for storage within the pockets. The pockets are composed of padded protective material, to ensure that each sub-assembly is protected, even when the bag or container is subjected to rough treatment. The wrench and screwdriver shown in FIG. 6 may be maintained within a tool pocket so that they can be used for assembly or disassembly as needed, and can be secured against becoming lost when they are not needed.

The front and rear bag sections are connected by one or more zipper connectors 138 or connectors employing hook and loop fastener material, such as is typically sold under the registered trademark "Velcro". The padded storage and transportation bag or container is provided with carry handles 140 and 142 that are fixed to each of the front and rear bag sections and is provided with sling connectors 144 and 146 to which a sling devise 148 may be connected to enable the bag or container to be carried hands-free by means of the sling.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A firearm having the capability for assembly and disassembly under field conditions, comprising:

upper and lower receivers being secured in releasable pivotal assembly by a pivot pin and being locked in assembly by a locking pin;

a barrel mount and a handguard mount being defined by said upper receiver, said handguard mount having a first handguard mounting face;

a barrel assembly being releasably secured to said barrel mount;

a generally tubular handguard member being releasably positioned about said barrel assembly and defining a second handguard mounting face and being releasably positioned with said second handguard mounting face in face-to-face engagement with said first handguard mounting face; and a manually actuated clamp mechanism having a clamping condition releasably securing said handguard to said upper receiver and having a releasing condition permitting separation of said handguard from said upper receiver and permitting removal of said handguard from said upper receiver.

2. The firearm of claim 1, comprising:

said upper receiver having a handguard mounting flange; and said manually actuated clamp mechanism having a retaining portion establishing retaining engagement with said handguard mounting flange when in said clamping condition and securing said generally tubular handguard member firmly to said upper receiver member.

3. The firearm of claim 1, comprising:

said upper receiver having a handguard mounting flange;

said manually actuated clamp mechanism having a retainer member establishing clamping engagement with said handguard mounting flange; and a clamp actuating lever having movable connection with said retainer member and having a clamping condition positioning said retainer member in clamping relation with said handguard mounting flange and securing said generally tubular handguard member in releasable relation with said upper receiver, said clamp actuating lever having a release position disengaging said retainer member from said handguard mounting flange and permitting separation of said generally tubular handguard member from said upper receiver.

4. The firearm of claim 3, comprising:

said clamp actuating lever being pivotally mounted to said generally tubular handguard member and having a condition of over-center actuation with said retainer member and when moved to said clamping condition applying a traction force to said retainer member urging said first and second mounting faces to secure face-to-face engagement.

5. The firearm of claim 3, comprising:

a moveable fastener member having a locking position securing said clamp actuating lever at said clamping condition and having an unlocked position permitting movement of said clamp actuating lever from said clamping condition toward said release position.

6. The firearm of claim 5, comprising:

said clamp actuating lever having a flexible free end portion being positioned in engagement with a surface of said generally tubular handguard member when said clamp actuating lever is located at said locking position and securing said clamp actuating lever against inadvertent movement; and said moveable fastener member being pivotally mounted to said generally tubular handguard member and being manually rotated to a locked position in retaining engagement with said flexible free end portion of said clamp actuating lever and to a release position out of retaining engagement with said flexible free end portion of said clamp actuating lever and permitting manual movement of said clamp actuating lever toward said release position thereof.

7. The firearm of claim 1, comprising:

Said upper receiver having a forward end portion and said generally tubular handguard member having a rear end portion;

a first handguard mounting flange located at said forward end portion of said upper receiver and defining said first handguard mounting face, said first handguard mounting flange having portions thereof projecting laterally from said upper receiver;

a second handguard mounting flange located at said rear end portion of said generally tubular handguard member; and said manually actuated clamp assembly being mounted to said second handguard mounting flange and having clamping engagement with said first handguard mounting flange.

8. The firearm of claim 1, comprising:

a butt-stock assembly being releasably mounted to said lower receiver and having a buffer tube containing a buffer spring; and a spring keeper securing said buffer spring within said buffer tube and ensuring retention of said buffer spring within said buffer tube upon disassembly of said butt-stock assembly from said lower receiver.

9. The firearm of claim 1, comprising:

alignment pin members extending from said tubular handguard member and having aligning engagement with first handguard mounting flange of said upper receiver and establishing precise alignment of said tubular handguard member with said upper receiver during assembly of said tubular handguard member to said upper receiver.

10. The firearm of claim 1, comprising:

a protective storage and transportation container having front and rear container sections connected by a center-fold section, permitting interior surfaces of said front and rear container sections to be positioned in face-to-face relation when said protective storage and transportation container is folded at said center-fold section from an open condition to a closed condition;

a plurality of firearm module and tool pockets being located on interior portions of said front and rear bag sections and having pocket openings through which firearm modules are inserted into said firearm module pockets, said firearm module and tool pockets being composed of protective padded material;

fastener devices being located at edge portions of said front and rear container sections and permitting fastening of said front and rear sections at said closed condition; and carry handle members being secured to at least one of said front and rear container sections and permitting manual transportation of said firearm modules within said protective storage and transportation container.

11. A firearm having modular sections for protective storage and for assembly and disassembly under field conditions, comprising:

upper and lower separable receiver sections being secured in releasable pivotal assembly by a pivot pin and being locked in assembly by a locking pin;

a barrel mount and a first handguard mount flange being defined by said upper receiver section, said first handguard mount flange defining a first handguard mounting face;

a barrel assembly section being releasably secured to said barrel mount by a barrel nut of said barrel assembly section;

a generally tubular handguard section being releasably positioned about said barrel assembly section and defining a second handguard mount flange having a second handguard mounting face and being releasably positioned with said second handguard mounting face in face-to-face engagement with said first handguard mounting face; and a manually actuated clamp mechanism having a clamping condition releasably clamping said first handguard mount flange to said second handguard mount flange and having a releasing condition permitting separation of said first and second handguard mount flanges and permitting removal of said handguard section from said upper receiver section.

12. The firearm of claim 11, comprising:

a protective storage and transportation container having front and rear container sections connected by a center-fold section, permitting interior surfaces of said front and rear container sections to be positioned in face-to-face relation when said protective storage and transportation container is folded at said center-fold section from an open condition to a closed condition;

a plurality of firearm module and tool pockets being located on interior portions of said front and rear container sections and having pocket openings through which firearm modules are inserted into said firearm module pockets, said firearm module and tool pockets being composed of protective padded material;

fastener devices being located at edge portions of said front and rear container sections and permitting fastening of said front and rear sections at said closed condition; and carry handle members being secured to at least one of said front and rear container sections and permitting manual transportation of said firearm modules within said protective storage and transportation container.

13. The firearm of claim 12, comprising:

a sling member being mounted to at least one of said front and rear container sections and permitting manual transportation of said protective storage and transportation container and the modules of said firearm by said sling member.

14. The firearm of claim 11, comprising:

a handguard mounting flange being defined by said upper receiver section; and said manually actuated clamp mechanism having a retaining portion establishing retaining engagement with said first handguard mounting flange when in said clamping condition and securing said generally tubular handguard member firmly to said upper receiver member; and a clamp actuating lever being pivotally mounted to said generally tubular handguard member and having a condition of over-center actuation with said retainer member and when moved to said clamping condition applying a traction force to said retainer member urging said first and second mounting faces to secure face-to-face engagement with said retainer member and having a clamping condition positioning said retainer member in clamping relation with said handguard mounting flange and securing said generally tubular handguard member in releasable relation with said upper receiver, said clamp actuating lever having a release position disengaging said retainer member from said handguard mounting flange and permitting separation of said generally tubular handguard member from said upper receiver.

15. The firearm of claim 14, comprising:

a moveable fastener member having a locking position securing said clamp actuating lever at said clamping condition and having an unlocked position permitting movement of said clamp actuating lever from said clamping condition toward said release condition;

said clamp actuating lever having a flexible free end portion being positioned in engagement with a surface of said generally tubular handguard member when said clamp actuating lever is located at said locking position; and said moveable fastener member being pivotally mounted to said generally tubular handguard member and being manually rotated to a locked position in retaining engagement with said flexible free end portion of said clamp actuating lever and to a release position out of retaining engagement with said flexible free end portion of said clamp actuating lever and permitting manual movement of said clamp actuating lever toward said release position thereof.

16. The firearm of claim 11, comprising:

said upper receiver section having a forward end portion and said generally tubular handguard section having a rear end portion;

a first handguard mounting flange located at said forward end portion of said upper receiver section and defining said first handguard mounting face, said first handguard mounting flange having portions thereof projecting laterally from said upper receiver section;

a second handguard mounting flange located at said rear end portion of said generally tubular handguard section; and said manually actuated clamp assembly being mounted to said second handguard mounting flange and having clamping engagement with said first handguard mounting flange.

17. The firearm of claim 11, comprising:

a butt-stock section being releasably mounted to said lower receiver section and having a buffer tube containing a buffer spring; and a spring keeper securing said buffer spring within said buffer tube and ensuring retention of said buffer spring within said buffer tube upon disassembly of said butt-stock assembly from said lower receiver.

18. The firearm of claim 11, comprising:

alignment pin members extending from said tubular handguard member and having aligning engagement with first handguard mounting flange of said upper receiver and establishing precise alignment of said tubular handguard member with said upper receiver during assembly of said tubular handguard member to said upper receiver.

* * * * *